US007234263B2

(12) United States Patent
Thiakos

(10) Patent No.: US 7,234,263 B2
(45) Date of Patent: Jun. 26, 2007

(54) FIREARM BORE LIGHT

(76) Inventor: Thomas G. Thiakos, 2435 W. 57th Pl., Merrillville, IN (US) 46410

( * ) Notice: Subject to any disclaimer, the term of this patent is extended or adjusted under 35 U.S.C. 154(b) by 0 days.

(21) Appl. No.: 10/930,497

(22) Filed: Aug. 31, 2004

(65) Prior Publication Data

US 2005/0115139 A1 Jun. 2, 2005

Related U.S. Application Data

(60) Provisional application No. 60/500,120, filed on Sep. 4, 2003.

(51) Int. Cl.
*F41A 15/00* (2006.01)

(52) U.S. Cl. ..... 42/90; 356/241.2

(58) Field of Classification Search ..... 42/90, 42/95, 106; 356/241.1, 241.2, 241.5; 362/551, 362/555

See application file for complete search history.

(56) References Cited

U.S. PATENT DOCUMENTS

| | | | | |
|---|---|---|---|---|
| 4,339,200 | A | 7/1982 | Corbin | |
| 5,365,332 | A | 11/1994 | Barber, Jr. et al. | |
| 5,551,182 | A | 9/1996 | Dahlitz et al. | |
| 6,811,280 | B1 * | 11/2004 | Sharrah et al. | 362/202 |
| 6,857,771 | B2 * | 2/2005 | Guerrieri | 362/555 |

* cited by examiner

*Primary Examiner*—J. Woodrow Eldred
(74) *Attorney, Agent, or Firm*—Katten Muchin Roseman LLP; John S. Paniaguas

(57) ABSTRACT

A firearm bore light includes a miniature light source with a removable head. The removable head is configured with a plastic light tube that is adapted to be inserted into the bore end of a firearm. Another optional head allows the device to be used as a miniature flashlight. High intensity LEDs are used for the light source to provide optimal operation in virtually any lighting conditions.

7 Claims, 1 Drawing Sheet

FIREARM BORE LIGHT

CROSS REFERENCE TO RELATED APPLICATION

The present application claims the benefit under 35 U.S.C. § 119(e) of copending U.S. provisional patent application No. 60/500,120, filed on Sep. 4, 2003.

BACKGROUND OF THE INVENTION

1. Field of the Invention

The present invention relates to a firearm bore light and more particularly to a relatively compact firearm bore light that can be clipped to a keychain and includes a removable head that allows the device to alternatively be used as a pocket flashlight.

2. Description of the Prior Art

Bore lights are known to be used to inspect the barrel or bore of a firearm to check for wear, obstructions or other defects. Examples of such firearm bore lights are disclosed in U.S. Pat. Nos. 4,339,200; 5,365,332 and 5,551,182. The bore light disclosed in U.S. Pat. No. 5,365,332 is configured to be used with ambient light and is configured as an L-shaped member defining two legs. One leg is disposed within the bore of the firearm opposite of the muzzle end. The other leg is pointed toward a source of ambient light. Once the firearm bore light is inserted into the bore, the operator is able to view the interior of the gun barrel from the muzzle end. Unfortunately, the firearm bore light disclosed in the '332 patent can only be used with firearms where access to the bore is provided. In addition, with such a firearm bore light, its effectiveness is a function of the available ambient light.

In order to solve this problem, U.S. Pat. Nos. 4,339,200 and 5,551,182 include integral sources of light. In particular, the '200 patent discloses a firearm bore light which includes a source of light, such as a flashlight and a light rod. A mirror and light disbursing lens is disposed at the extended end of the light rod to reflect light toward the muzzle end of the barrel. As such, in order to view the entire length of the barrel, the light rod has to be fairly long causing this device to be relatively bulky. In addition, the need for the mirror and lens makes the devise rather complicated and thus expensive to manufacture.

U.S. Pat. No. 5,551,182 discloses a firearm bore light which essentially consists of a miniature flashlight, configured to be placed inside of a gun barrel and successively positioned along the length of the barrel by tilting the gun barrel causing the bore light to slide away from the muzzle end.

There are several problems with the device disclosed in the '182 patent. First, the device is not suitable for all types of firearms. For example, although the device may work with long barrel firearms, such as rifles and shotguns, it is not suitable for handguns. In addition, when the firearm bore light is at the furthest position from the muzzle end of the gun barrel, it will cover up a portion of the gun barrel preventing that portion from being inspected. Thus, there is a need for a firearm bore light which has an integral light source and is compact and does not block a portion of the barrel from being inspected.

SUMMARY OF THE INVENTION

Briefly, the present invention relates to a firearm bore light. The firearm bore light includes a miniature light source with a removable head. The removable head is configured with a plastic light tube adapted to be inserted into the bore end of a firearm. Another optional interchangeable head allows the device to be used as a miniature flashlight. High intensity LED is used for the light source to provide optimal operation in virtually any lighting conditions.

DESCRIPTION OF THE DRAWING

These and other advantages of the present invention will be readily understood with reference to the following specification and attached drawing wherein.

DETAILED DESCRIPTION

The present invention relates to a firearm bore light which includes a light source and one or more removable heads. One removable head, as will be discussed in more detail below, includes a light tube configured to be inserted into the bore end of a gun barrel. An optional interchangeable second head may be provided so that the device can alternatively be used as a miniature flashlight. The light source is a high intensity light emitting diode (LED) which provides relatively optimal lighting in virtually any lighting condition. Compared to known bore lights, the bore light in accordance with the present invention is relatively compact in size and includes a relatively brighter light source than known firearm bore lights.

Figure 1:
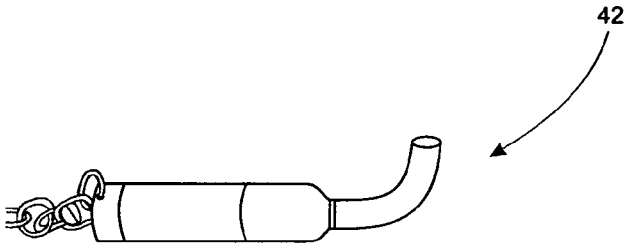
FIG. 1 is a perspective view of a firearm bore light in accordance with the present invention.
Figure 2:
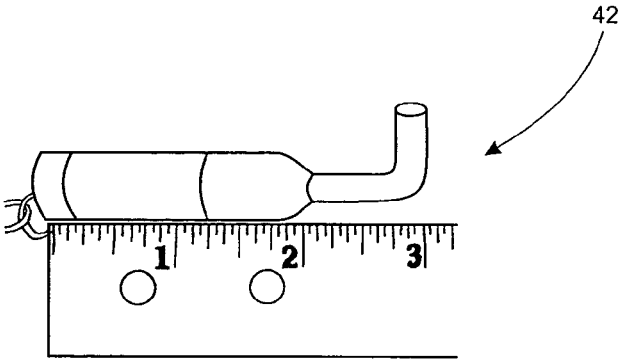
FIG. 2 is similar to FIG. 1 which includes a scale to illustrate the size of the device.
Figure 3:
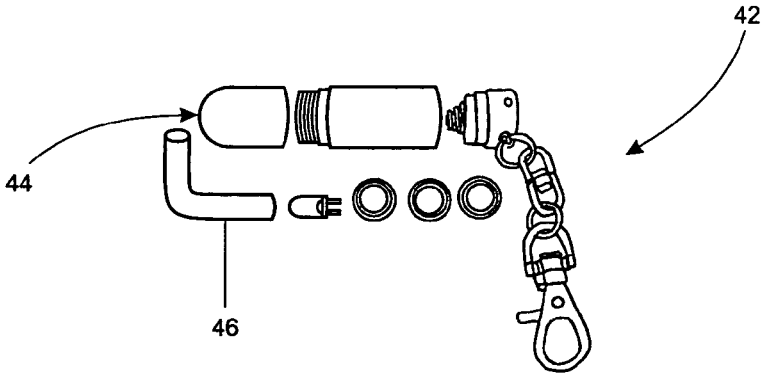
FIG. 3 is an exploded perspective of the device with the bore light head.
Figure 4:
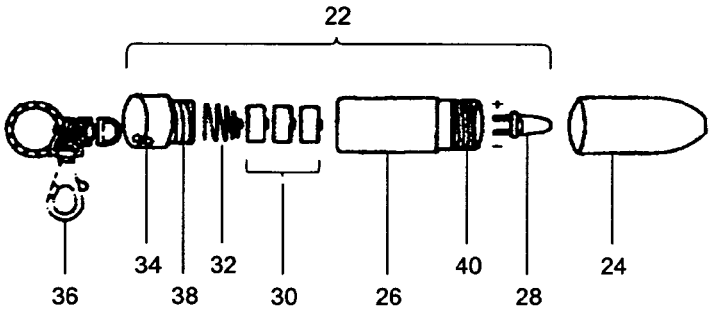
FIG. 4 is similar to FIG. 3 but with a exemplarily flashlight head.

Referring to the drawing, FIGS. 1-3 illustrate the device with a removable head for use as firearm bore light. FIG. 4 illustrates an exemplary light source and an exemplary head for use as a compact flashlight.

The exemplary light source is illustrated in FIG. 4 and generally identified with the reference numeral 22. The exemplary light source 22 includes a battery compartment 26, a high intensity light emitting diode LED 28, for example, a white LED, three (3) batteries, for example, Duracell PX76A/LR44 batteries 30, a battery spring 32, and a cap 34. An optional keychain, 36, may be attached to the cap. In addition optional seals, 38 and 40, may be provided to seal the cap 34, and the head 24 to the light source, 22. The light source together with a removable flash light head 24 is exemplary and is commercially available as model no. LED#15-325 flashlight from Versalight Systems Co. Ltd., a/k/a Chang Chen Instrument Co., Taoyvan Hsien, Taiwan. Other light sources are also suitable.

Referring to FIGS. 1-3, in accordance with an important aspect of the invention, the firearm bore light in accordance with the present invention is generally identified with the reference numeral 42 and includes a light source, for example the light source 22, and an interchangeable head 44. The interchangeable head 44 carries a light tube, for example, an acrylic tube that may be either straight or bent on an angle, such as 90°. The interchangeable head 44 includes a cap that is suitable for mating with the battery compartment 26, and includes an opening for receiving the acrylic light tube 46.

The light tube 46 is configured for total internal reflection to optimize the transfer of light from the light source 22 through the light tube 46. In order to further optimize the coupling between the LED 28 and the light tube 46, the interior end of the light tube 46 may be provided a cylindrical bore (not shown) so as to circumscribe the LED 28 when the device is assembled.

In accordance with an important aspect of the invention the light source 22 includes a high intensity LED. The LED may be, for example, a white LED, model number NSPW500BS, available from Nichia America Corporation in Mountville, Pa. The LED provides a brighter source of light for inspecting the barrels of firearms to insure that the barrel is free of foreign objects and to allow the user to detect various defects, such as barrel leading, contamination, clogging, rusting, pits and worn rifling.

Obviously many modifications and variations of the present invention are possible in light of the above teachings. Thus, it is to be understood that, within the scope of the appended claims, the invention may be practiced otherwise than as specifically described above.

I claim:

1. A firearm bore light comprising:

a light source;

a battery compartment for carrying said light source and at least one battery;

a head configured to be rigidly secured to said battery compartment forming a bore light assembly, said head including a light tube extending axially therefrom for directing light down an entire length of a gun barrel having a predetermined length from a bore end; said light tube configured to direct the light from the light source through the light tube, the light tube further configured to enable it to be inserted into the bore end of a gun barrel and enable inspection of the gun barrel from said bore end, said bore light assembly being relatively compact and being formed less than the length of said gun barrel.

2. The firearm bore light as recited in claim 1, wherein said head is removable.

3. The firearm bore light as recited in claim 1, wherein said light source is a high intensity LED.

4. The firearm bore light as recited In claim 1, wherein said light tube is formed from a solid transparent tube.

5. The firearm bore light as recited in claim 4, wherein said light tube is formed from acrylic.

6. The firearm bore light as recited in claim 4, wherein said light source comprises a LED and one end of said light tube is formed with an opening for receiving said LED.

7. The firearm bore light as recited in claim 4, wherein said light source and light tube are configured for total internal reflection through said light tube.

* * * * *